United States Patent [19]

Pike et al.

[11] Patent Number: 5,021,917

[45] Date of Patent: Jun. 4, 1991

[54] CONTROL PANEL POWER ENABLING AND DISABLING SYSTEM FOR AERIAL WORK PLATFORMS

[75] Inventors: Ronald L. Pike, Waynesboro; Ronald W. Beckley, State Line, both of Pa.

[73] Assignee: Kidde Industries, Inc., Iselin, N.J.

[21] Appl. No.: 471,797

[22] Filed: Jan. 29, 1990

[51] Int. Cl.[5] ..... H01H 47/18

[52] U.S. Cl. ..... 361/195; 182/2

[58] Field of Search ..... 361/195; 307/141, 141.4, 307/132 E, 132 R, 132 M, 326, 328, 592, 598; 340/527; 182/2

[56] References Cited

U.S. PATENT DOCUMENTS 3,721,866 3/1973 McIntosh ..... 361/195

4,366,366 12/1982 Ekblad ..... 361/195

*Primary Examiner*—Todd E. DeBoer

*Assistant Examiner*—Brian Johansson

*Attorney, Agent, or Firm*—Brady, O'Boyle & Gates

[57] ABSTRACT

A control panel enabling and automatically disabling system is coupled between a source of electrical power and a plurality of motion controls on an aerial work platform. Upon activation of a pushbutton type power enabling switch, power is coupled to all the motion controls for a predetermined fixed time period which when activated will couple power to a respective motion producing mechanism such as a boom actuator. If none of the motion controls are activated by an operator within this time period, a timer times out and the panel thereafter becomes inactive by interrupting the electrical power. However, if a motion command is effected by actuation of any one of the motion controls during this time period, the timer is automatically reset to zero time and held thereat until all motion commands cease, at which time the timer is restarted. The enabling switch cannot be defeated by a continuous activation thereof. The enabling switch must be released and pushed again to start a new cycle. Further if a motion command is generated by inadvertent movement of one of the motion controls prior to the power enabling switch being activated, the system will not activate. All motion commands must cease before operation of the enabling switch can activate the timer and energize the system.

14 Claims, 4 Drawing Sheets

CONTROL PANEL POWER ENABLING AND DISABLING SYSTEM FOR AERIAL WORK PLATFORMS

BACKGROUND OF THE INVENTION

This invention relates generally to electrical control systems and more particularly to an electrical system for disabling or interrupting electrical power applied to apparatus producing motion of an aerial work platform due to inadvertent or accidental actuation of a motion control device located on the upper control box.

Systems for preventing the unintentional operation of mechanical and electrical propulsion systems are generally known and take many forms. For example, a vehicle might contain selectively placed switches wherein the drive power to the traction means is interrupted when the operator leaves his operating station and thereafter prevents unintentional movement of the vehicle upon the return of the operator to the operating station without making a positive effort to properly reestablish conditions for operation. Also known are systems which automatically shut down motor operation whenever an adverse operating condition is detected. With respect to electrical equipment including household appliances, there are known systems which automatically interrupt power in the event that the apparatus is left unattended for a predetermined time to reduce the hazard associated therewith.

Accordingly, it is an object of the present invention to provide an improvement in electrical control apparatus which prevents undesired energization of motion producing apparatus.

It is another object of the invention to provide an electrical control circuit for enabling and automatically disabling the application of power to motion producing apparatus on an aerial work platform.

It is yet another object of the invention to inhibit the risk of accidents due to an operator or an obstruction or workpiece inadvertently contacting and operating a motion control device located on the upper control box of an aerial work platform while an operator is performing a predetermined task thereat.

Still a further object of the invention is to prevent inadvertent operation of an aerial work platform which would cause the platform or vehicle to move accidentally and which might thereby cause injury to the operator and/or personnel in the vicinity of the aerial work platform.

SUMMARY

Briefly, the foregoing and other objects are achieved by means of a control panel enabling an automatically disabling system which is coupled between a source of electrical power and the motion producing devices of an aerial work platform. It includes a power enabling momentary actuated switch coupled to a delay-on-break timing circuit through a single pulse generating RC network. The timer in turn is coupled to a power enabling relay, which when activated couples power to a plurality of motion control switches, which operate to couple electrical power to a respective motion producing device. Upon activation of any motion control switch, a timer hold at zero time relay is energized. This relay includes a set of relay contacts which when closed connects the timer outputs back to its input and thus operates to hold the timer at zero time during any motion command. Upon activation of the power enabling switch which may be, for example, a pushbutton switch, power is coupled to all the motion controls for a predetermined fixed time period, typically five seconds. If none of the motion controls are activated by an operator within this time period, the timer times out and the panel thereafter becomes inactive by interrupting the electrical power. However, if a motion command is effected by actuation of any one of the motion controls during the five second time period, the timer is automatically reset to zero time by the aforesaid relay contacts and held thereat until all motion commands cease, at which time the timer is restarted. The enabling switch cannot be defeated by the continuous activation thereof, since only a single pulse is fed to the timer. The enabling switch must be released and pushed again to start a new cycle. Further if a motion command is activated by movement of one of the motion controls prior to the power enabling switch being activated, the system will not activate. All motion commands must be off before an enabling command will activate the timer and energize the power enabling relay.

BRIEF DESCRIPTION OF THE DRAWINGS

This invention will be more readily understood when the following detailed description is considered together with the accompanying drawings wherein.

DETAILED DESCRIPTION OF THE INVENTION

Figure 1:
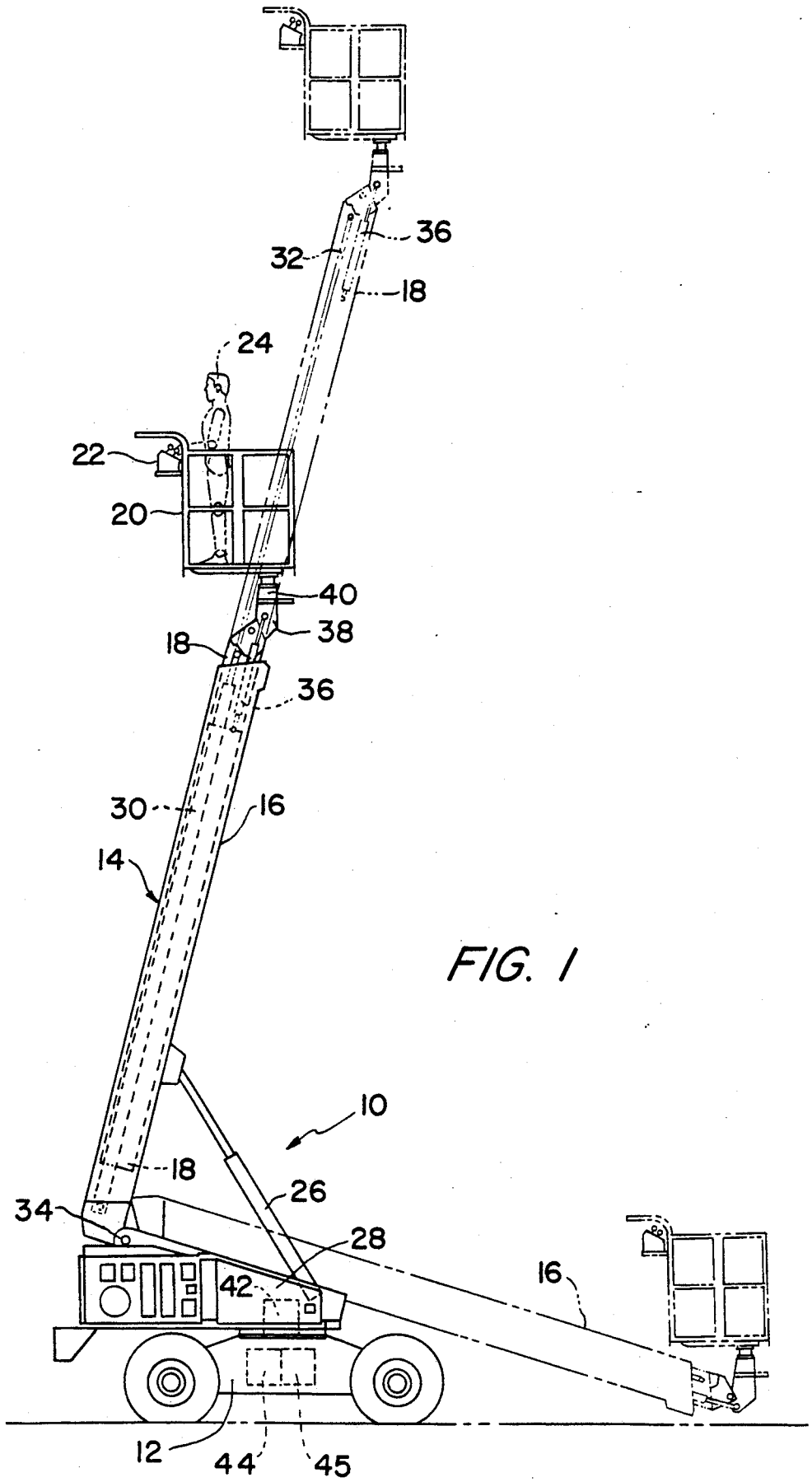
FIG. 1 is planar view of an aerial work platform which is controlled by the subject invention.

Referring now to the drawings wherein like reference numerals refer to like parts and more particularly to FIG. 1, shown thereat is an aerial work platform 10 comprised of a wheeled carriage 12 supporting a telescoping boom structure 14 including, for example, a pair of telescoping boom sections comprised of an outer section 16 and an inner section 18, with a work platform in the form of an upper control box 20 being mounted on the outer end of the inner section 18. The control box 20 is often referred to as a "cherry picker" or aerial platform. Further as shown in FIG. 1, is a control panel 22 which permits an operator 24 stationed in the upper control box 20 to control all vehicle and upper control box motion including not only boom elevation, but also extension and attitude control of the work platform, as well as the steered movement of the carriage 12 itself.

The boom structure 14 is shown in FIG. 1 in an elevated position; however, phantom views also depict the boom in a lowered position with the inner section 18 retracted as well as in an elevated position with the inner section extended.

A hydraulic boom lift cylinder 26 is connected between a turntable superstructure member 28 and the outer boom section 16 and is controllable from the control panel 22 to elevate the boom 14 about its pivot connection 34 with the turntable superstructure 28 as required during a work operation. A power cylinder 30 including a piston rod member 32 connected to the inner boom 18 and a cylinder connected to the outer boom 16 controls the telescoping extension of the inner section 18 and is also controlled from the control panel 22. A relatively small power cylinder 36, located in the far or distal end of the inner section 18, moreover, is coupled between the inner section 18 and a platform support bracket 38 and operates from the control panel 22 to level the upper control box 20 as it is moved. At the upper end of the support bracket 38 is located a platform rotating mechanism 40 which can also be controlled from the control panel 22.

In addition to the aforementioned motion producing mechanism, the turntable superstructure member 28 on carriage 12 is also equipped with a mechanism 42 for providing turntable and boom rotation. The carriage 12 additionally includes a carriage drive mechanism and a carriage steering mechanism shown schematically by reference numerals 44 and 45. These elements may be located differently than schematically shown on the vehicle, but are also under operator control at the control panel 22.

Figure 2:
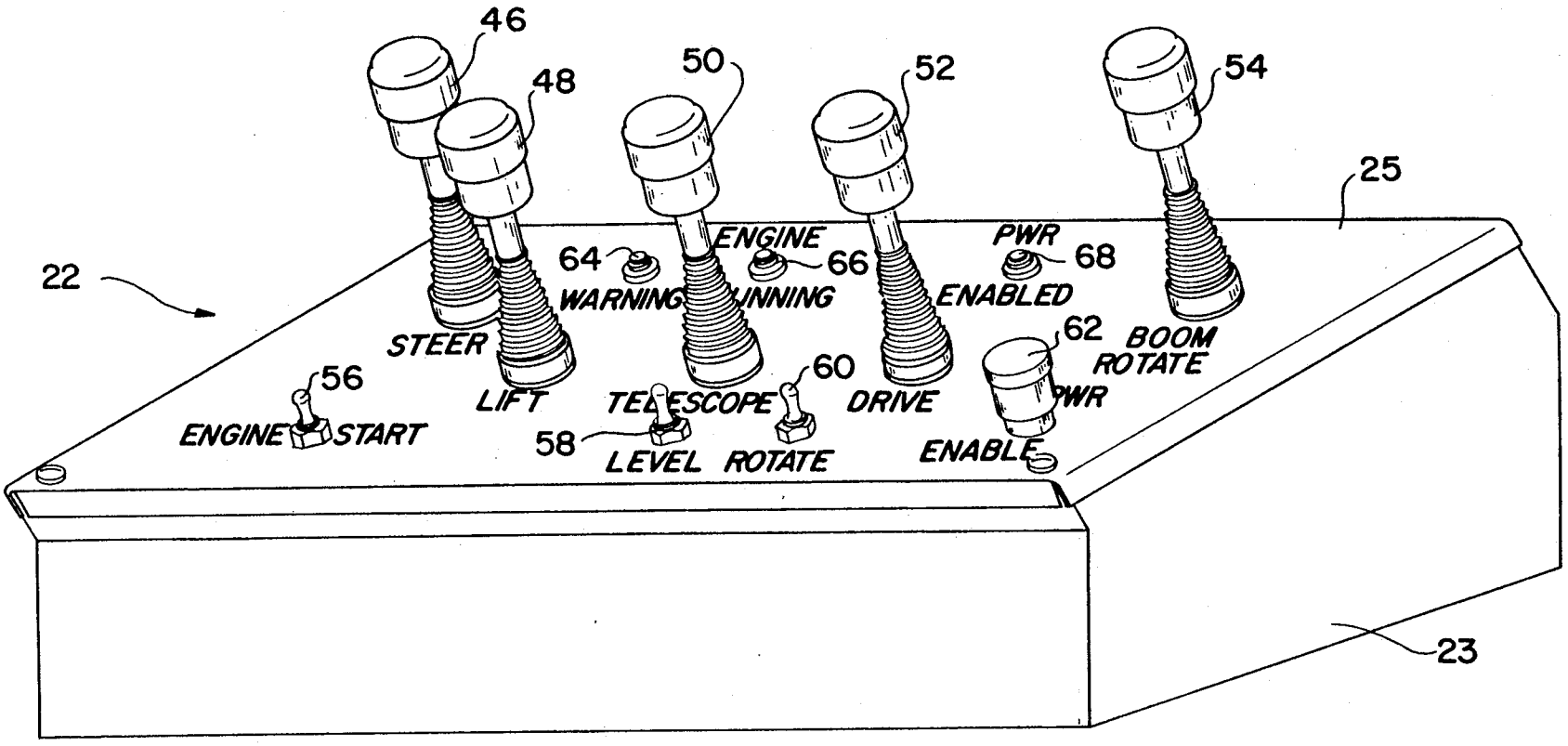
FIG. 2 is a perspective view of a control panel located at the upper control box of the aerial work platform shown in FIG. 1.

Referring now to FIG. 2, shown thereat is a perspective view which is illustrative of the control panel 22 and which is comprised of a housing 23 containing the electrical circuitry to be described subsequently. The housing 23 is equipped with a flat panel or cover plate 25. Mounted on the cover plate 25 is a plurality of electrical control switch devices including joy stick type and toggle switch devices which can be activated by the operator 24 while on the work platform 20. Although not shown, a dust cover can be provided when desired for protecting the apparatus when not in use.

The control switches mounted on the cover plate 25 include five joy stick type switches 46, 48, 50, 52 and 54 which include respective spring loaded handles which automatically return to open switch positions when released following manual actuation. The two upper joy stick controls 46 and 54 provide for carriage steering and boom rotation, respectively, while the three lower joy stick controls 48, 50 and 52 provide for boom lift, boom extension and carriage drive, respectively. Three toggle switches 56, 58 and 60, as well as a push button switch 62 are located below the joy stick controls to provide an engine start control, a platform level control, a platform rotate control, and a power enabling switch, respectively. Three indicator lights 64, 66 and 68 are also shown and provide a visual warning indication, an engine running indication, and a power enabled indication, respectively.

Figure 3:
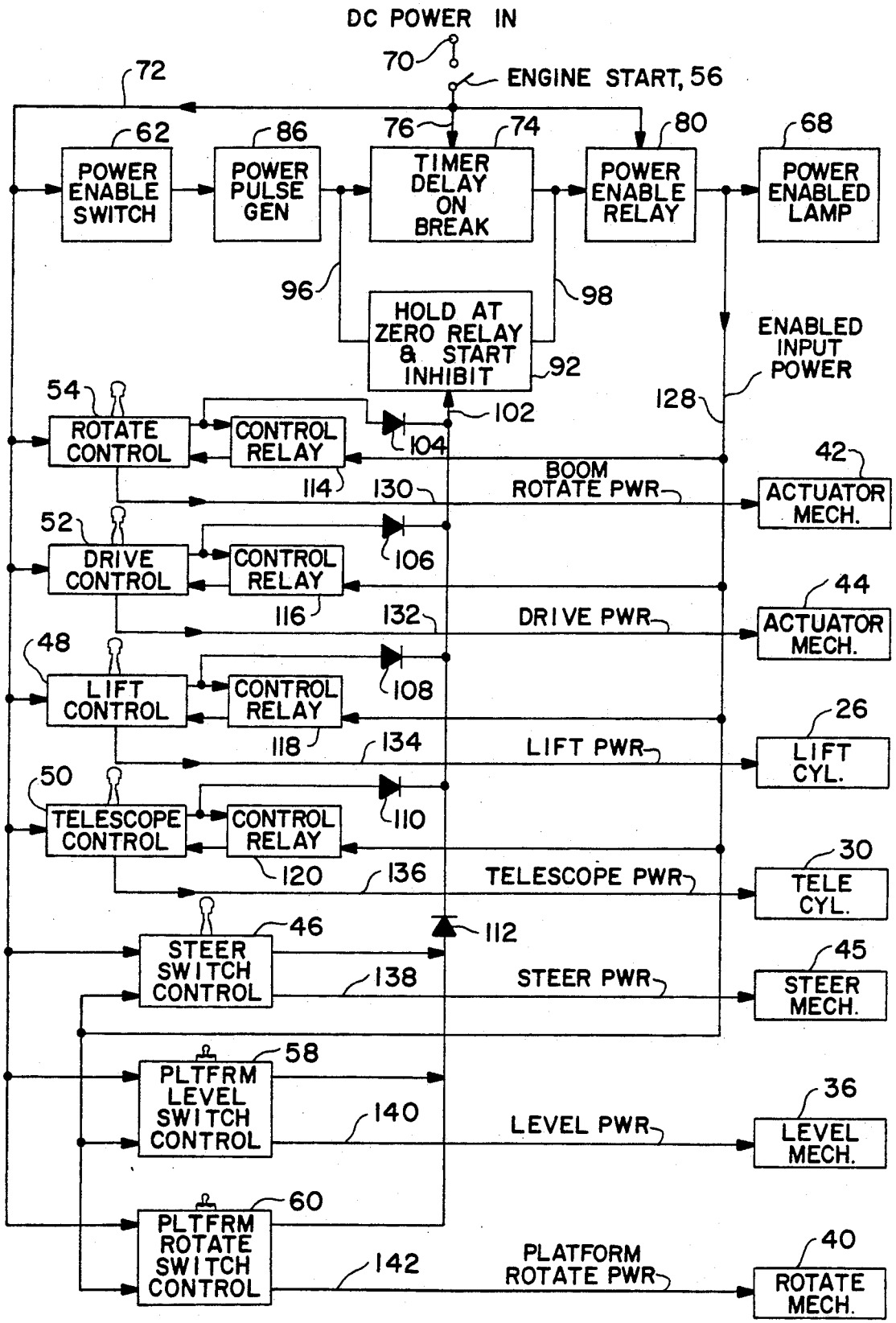
FIG. 3 is an electrical block diagram illustrative of the preferred embodiment of the invention.
Figure 4:
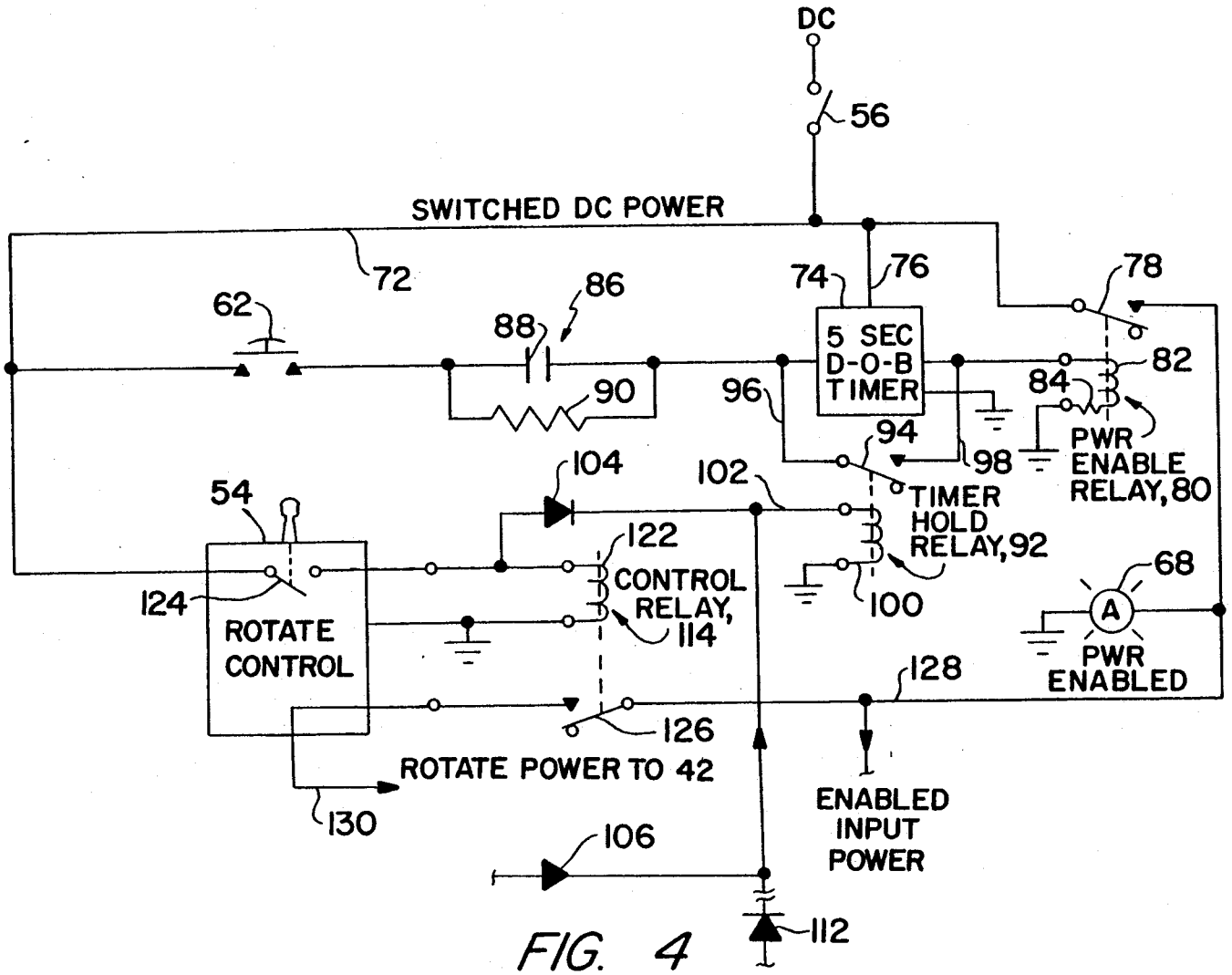
FIG. 4 is a partial electrical schematic diagram further illustrative of the preferred embodiment of the invention shown in FIG. 3.

This now leads to a consideration of the electrical circuitry implementing this invention. Referring now collectively to FIGS. 3 and 4 where FIG. 3 discloses an electrical block diagram of the preferred embodiment of the subject invention, while FIG. 4 comprises a partial electrical schematic thereof, DC power from a source such as a 12-volt vehicle battery, not shown, is connected to terminal 70 where it is fed to the engine start switch 56. The switch 56 in turn is connected to the five joy stick controls 46, 48, 50, 52, 54, the two toggle switches 58 and 60 and the power enable pushbutton switch 62 via a common power lead 72.

As shown in FIG. 4, the engine start switch 56 is also connected to a timer circuit 74 via power lead 76 and the contacts 78 of a power enable relay 80 which additionally includes a relay control coil 82. Typically, the DC resistance 84 of the relay coil can be in the order of 18 kilohms, before the circuit ceases to function. The resistance of the relay used, for example, is 200 ohms. This is an important feature and will be referred to again subsequently.

The timer 74 comprises a delay-on-break (D-O-B) timer which operates to interrupt the circuit into which it is connected after a predetermined time delay after being energized. In the subject invention, the timer 74 is selected to have a five second (5 sec.) time delay. The timer 74 in FIG. 4 is shown coupled between a coil 82 of the power enable relay 80, and a single pulse generator circuit 86 (FIG. 3) comprised of a parallel resistance-capacitance network including capacitor 88 and resistor 90. The other end of the parallel combination of capacitor 88 and resistor 90 is coupled to the power enable pushbutton switch 62.

The invention additionally includes a hold relay 92 for the timer 74 which includes a set of relay contacts 94 which are coupled between the input and output of the timer by means of circuit leads 96 and 98. The timer hold relay 92 additionally includes a relay coil 100 (FIG. 4) which is commonly coupled to all of the motion control elements 46, 48, 50, 52, 54, 58 and 60 via circuit lead 102 and semiconductor blocking diodes 104, 106, 108, 110 and 112 as shown in FIG. 3. Actuation of any one of these motion controls operates to couple DC potential to the timer hold relay coil 100 through a semiconductor diode.

Additionally, the rotate control switch 54, the drive control switch 52, the lift control switch 48 and the telescope control switch 50 are coupled to energize respective control relays 114, 116, 118 and 120. The control relay 114 is shown in detail in FIG. 4 and typifies the other three relays in that it includes a relay coil 122 which is coupled to a pair of switch contacts 124 in the joy stick switch mechanism. Additionally, the control relay 114 includes a set of relay contacts 126 which are coupled to an enabled DC power lead 128, coupled to the relay contacts 78 of the power enable relay 80.

Thus when the power enable relay contacts 78 are closed, and one of the control switches, for example, the rotate control switch 54 is manually actuated, relay contacts 126 close and couple DC power on power lead 128 to the actuator mechanism 42 by power lead 130. In the same fashion, control relay 116 as shown in FIG. 3 operates to feed DC power to the actuator 44 via power lead 132 through the drive control switch 52. The control relay 118 couples lift power to actuate lift cylinder 26 via the power lead 134 and the control relay 120 couples telescope power to actuate telescope cylinder 30 via power lead 136 through the telescope control joy stick switch 50. The power lead 128 also couples directly to the steer joy stick control 46, the platform level switch 58 and the platform rotate switch 60, which respectively operate to couple power to their respective steer, level and rotate mechanisms 45, 36 and 40 via power leads 138, 140 and 142.

In operation, the inventive concept centers around the 5 sec. delay-on-break timer 74, the enable pushbutton switch 62, the parallel capacitor-resistor network 86, the power enabling relay 80 and the timer hold relay 92. Noting that all the joy stick controls 46, 48, 50, 52 and 54 automatically return to their respective "off" positions, when the power enable switch 62 is closed by a momentary manual actuation of the pushbutton switch assembly, a positive DC voltage pulse is generated in a well known fashion by the combination of the fixed capacitor 88 and the fixed resistor 90 and is fed to the input side of the timer 74. Only a single pulse is generated because the value of the resistance of the fixed resistor 90 is selected so as to permit discharge of the capacitor 88 but it prevents sufficient current from being fed from the power lead 72 to energize the timer 74 in the event that the pushbutton switch 62 is continually depressed or taped down by someone attempting to defeat the power disabling feature to be described.

When the pulse is applied to the timer 74, the power enable relay 80 is energized through the relay coil 82 and the switch contacts 78 as shown in FIG. 4 close. When this occurs, power enable lamp 68 is lighted, giving a visual indication that the controls are energized, and DC power is fed via the power lead 128 to all motion controls including the five joy stick control switches 46, 48, 50, 52 and 54 as well as the two toggle switches 58 and 60. The power enable relay 80, however, will only be energized for five seconds due to the timer 74 unless the timer hold relay 92 is energized by one of the aforementioned seven motion control switches 46, 48 . . . 58, 60 is actuated, which in turn causes the relay coil 100 to be energized from power lead 72 through a respective switch element and one of the diodes 104, 106, 108, 110 and 112.

When the timer hold relay 92 becomes energized, the relay contacts 94 (FIG. 4) close, causing circuit leads 96 and 98 to be connected together. This operates to hold the D-O-B timer 74 at a time zero which in effect deactivates the timer 74 while the particular motion control switch is being activated. Upon deactivation of the motion control device, the timer hold relay 92 becomes deenergized. This opens the relay contacts 94 to again set the 5 sec. D-O-B timer 74, after which the power enable relay 80 becomes deenergized to open relay contacts 78. The power enable lamp 68 goes out, and DC power is removed from all motion controls and their respective motion producing elements 26, 30, 36, 40, 42, 44 and 45 as shown in FIG. 3.

This constitutes the normal operation of the system. However, it is extremely important to note what happens if any of the motion control switches 46, 48, 50, 52, 54, 58 and 60, as shown in FIG. 3, are activated prior to the power enable switch 62 being manually depressed. Premature or inadvertent actuation of any of these motion controls on the panel 22, for example, the rotate joy stick 54, will energize its respective control relay 114 and at the same time energize the timer hold relay 92 via the diode 104. With the closure of the relay contacts 94, a series voltage divider circuit is provided by the fixed resistor 90 of the pulse generating network 86 and the internal resistance 84 of the power enable relay coil 82 as shown in FIG. 4. No energizing voltage for the power enable relay 80 would be applied to relay coil 82 which keeps the relay contacts 78 in an open circuit condition. No DC power would be applied to circuit lead 128 and thus none of the motion causing mechanisms 26, 30, 36, 40, 42, 44, 45 would be actuated; however, any subsequent closure of the power enable switch 62 causes a DC voltage to be applied across the voltage divider formed by the resistances 90 and 84. A DC voltage of a relatively lower amplitude value is thereby applied to the input of the D-O-B timer 74 and via closed contacts 94 to relay coil 82, which is insufficient to trigger the timer 74 and energize the coil 82. This will keep the power enable relay 80 deenergized. Thus no power can be applied to any of the motion generating devices 26, 30, 36, 40, 42, 44 and 45 unless the power enable switch 62 is first activated, followed by a manual activation of one of the motion controls 46, 48, 50, 52, 54, 58 and 60.

Thus what has been shown and described is a relatively simple yet efficient means for inhibiting undesired motion of the aerial work platform 10 by inadvertent or accidental actuation of the motion effecting controls while an operator 24 is performing a predetermined task while being stationed at the upper control box 20.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

We claim:

1. A control panel enabling and disabling system of an aerial work platform coupled between a source of electrical power and a plurality of motion producing mechanisms, comprising:

a respective plurality of motion controls coupled to said plurality of motion producing mechanisms for applying electrical power thereto from said source to command a predetermined motion of said aerial work platform;

first controllable switch means including means for coupling electrical power from said source to said plurality of motion controls;

timer means coupled to said first controllable switch means and including means for providing a continuous circuit therethrough for a predetermined time period upon being activated and thereafter providing an open circuit therethrough unless reactivated prior to the end of said predetermined time;

power enabling switch means coupled to said source of electrical power; circuit means coupled between said power enabling switch means and said timer means for activating said timer means to energize said first controllable switch means once each time said power enabling switch means is actuated; and second controllable switch means coupled to and being activated by any of said plurality of motion controls and including means coupled to said timer means for holding said timer in a continuous activated state so long as any one of said motion controls is activated to command a motion by a respective motion producing mechanism;

whereby said first controllable switch means enables power for use by said motion producing mechanisms only for said predetermined time period following actuation of said power enabling switch means unless one of said motion controls is thereafter activated.

2. The system as defined by claim 1 wherein said timer means comprises an electrical delay-on-break timer, and wherein said circuit means coupled between said power enabling switch means and said timer comprises single pulse generating circuit means.

3. The system as defined by claim 1 wherein said first and second controllable switch means comprises electrically controllable switch means.

4. The system as defined by claim 3 wherein said first and second electrically controllable switch means comprise electrical relay circuit means including relay contact means.

5. The system as defined by claim 4 wherein said timer means includes input means and output means and wherein said relay contact means of said second relay circuit means interconnects said input and output means of said timer when said second relay circuit means is energized.

6. The system as defined by claim 4 wherein said timer means includes input means and output means, and said means coupled to said timer means includes circuit means directly interconnecting said input and output means by said contact means of said second relay circuit means.

7. The system as defined by claim 6 wherein said first relay circuit means includes a relay energizing coil having a first electrical resistance of a predetermined value, and wherein said circuit means coupled between said power enabling switch means and said timer means comprises single pulse generating circuit means responsive to electrical power coupled thereto by said power enabling switch means and including a second electrical resistance of a predetermined value, said first and second resistance forming an electrical voltage divider with said contact means of said second relay circuit means and said directly interconnecting circuit means, whereby said timer and said first relay circuit means cannot be activated when any one of said motion controls is activated prior to said power enabling switch means being activated.

8. The system as defined by claim 7 wherein said single pulse generating circuit means comprises a parallel network including an electrical resistor and an electrical capacitor.

9. A control panel enabling and disabling system of an aerial work platform coupled between a source of electrical power and a plurality of motion producing mechanisms, comprising:

a respective plurality of motion controls coupled to said plurality of motion producing mechanisms for applying electrical power thereto from said source to command a predetermined motion of said aerial work platform;

first electrical relay circuit means including contact means for coupling electrical power from said source to said plurality of motion controls;

delay-on-break timer means coupled to said first relay circuit means and including means for providing a continuous circuit therethrough for a predetermined time period upon being activated and thereafter providing an open circuit therethrough unless reactivated prior to the end of said predetermined time;

power enabling switch means coupled to said source of electrical power;

circuit means coupled between said power enabling switch means and said timer means for activating said timer means to energize said first relay circuit means once each time said power enabling switch means is actuated; and second electrical relay circuit means coupled to and being activated by any of said plurality of motion controls and including contact means coupled to said timer means for holding said timer in a continuous activated state so long as any one of said motion controls is activated to command a motion by a respective motion producing mechanism;

said first relay circuit means includes a relay energizing coil having a first electrical resistance of a predetermined value, and wherein circuit means coupled between said power enabling switch means and said timer means comprises single pulse generating circuit means responsive to electrical power coupled thereto by said power enabling switch means and including a second electrical resistance of a predetermined value, said first and second resistance forming an electrical voltage divider with said contact means of said second relay circuit means;

whereby said first relay circuit means enables power for use by said motion producing mechanisms only for said predetermined time period following actuation of said power enabling switch means unless one of said motion controls is thereafter activated, and said timer means and first relay energizing coil cannot be activated when any one of said motion controls is activated prior to said power enabling switch means being activated.

10. The system as defined by claim 9 wherein said single pulse generating circuit means comprises a parallel network including an electrical resistor and an electrical capacitor.

11. The system as defined by claim 9 wherein said timer means includes input means and output means and wherein said relay contact means of said second relay circuit means interconnects said input and output means of said timer means when said second relay circuit means is energized.

12. The system as defined by claim 11 and additionally including circuit means directly interconnecting said input and output means by said contact means of said second relay circuit means.

13. The system as defined by claim 9 and additionally including a control panel and wherein said plurality of motion controls are located on said control panel.

14. The system as defined by claim 9 wherein said plurality of motion controls include a plurality of joy stick type switches.

* * * * *